United States Patent [19]

Hasegawa

[11] 4,033,212

[45] July 5, 1977

[54] METHOD OF AND DEVICE FOR SEVERING A VENEER SHEET

[75] Inventor: Katsuji Hasegawa, Nagoya, Japan

[73] Assignee: Meinan Machinery Works, Inc., Ohbu, Japan

[22] Filed: Feb. 3, 1975

[21] Appl. No.: 546,605

[30] Foreign Application Priority Data

Sept. 19, 1974 Japan ..... 49-108114

[52] U.S. Cl. ..... 83/13; 83/371

[51] Int. Cl.[2] ..... B26D 5/06; B26D 1/34

[58] Field of Search ..... 83/371, 13, 360, 365, 83/368, 370

[56] References Cited

UNITED STATES PATENTS 3,560,096 2/1971 Watson et al. ..... 83/371

3,735,657 5/1973 Schmidt et al. ..... 83/371

*Primary Examiner*—Donald R. Schran

*Attorney, Agent, or Firm*—Woodhams, Blanchard and Flynn

[57] ABSTRACT

A method of severing a veneer sheet comprising feeding a veneer sheet, sensing an irregularity or a predetermined length of said veneer sheet and actuating, in accordance with the sensing of the irregularity or the predetermined length of the veneer sheet, a cutter member pivotally disposed and having an edge portion adapted to work on the side of the fed-in veneer sheet during the pivotal movement of the cutter member. Severing can be done without stopping feeding of a veneer sheet and the arrangement of said cutter member realizes dividing of a feed-out passage of the veneer sheet into two different directions.

14 Claims, 13 Drawing Figures

METHOD OF AND DEVICE FOR SEVERING A VENEER SHEET

FIELD OF THE INVENTION

The present invention relates to a method of severing a veneer sheet without stopping feeding of said veneer sheet and a device for practising the method.

More particularly, the present invention relates to a method of and a device for severing a veneer sheet without stopping feeding of said veneer sheet, in which there is effectively utilized, for severing the veneer sheet, a force by which said veneer sheet is fed, thus speeding up the whole operation, obviating labor of separating scraps from veneer sheets of acceptable quality and facilitating performance of the severing operation systematically in combination with other operations which are involved in the manufacture of plywood such as cutting of a veneer sheet off of a log, stacking of severed veneer sheets, etc.

BACKGROUND OF THE INVENTION

In conventional methods, severing of such flat materials as veneer sheets is done by vertically shuttling a cutter member while the feed of a veneer sheet to be cut is temporarily stopped. Such conventional methods of severing a veneer sheet are not suitable for continuously operating the preparation of a veneer sheet from a log and severing the veneer sheet in combination, since the cutting operation of a veneer sheet off of a log is in general carried out continuously without stopping. Illustratively stated, in the conventional methods the feed of the veneer sheet must be temporarily stopped at the time of severing. However, the veneer sheet is, in general, continuously fed to the severing stage from the preceding stage of preparation of a veneer sheet from a log. Such continuous operation i.e. preparation of a veneer sheet from a log, can not be combined with the other intermittent operation, i.e. severing of the veneer sheet. Consequently, with the conventional severing methods and device, it is impossible to conduct the whole process for production of sized veneer sheets from a log in a systematic, continuous manner.

Another drawback of the conventional severing device and method is that after the severing operation severed veneer sheets are all fed out to the same place. Therefore, when the device is used for the purpose of removing inferior quality portions detected in a veneer sheet, removed scraps and the veneer sheet of acceptable quality are fed out to the same place and therefore, separation of them is additionally required. Meanwhile, when a veneer sheet is severed into a group of sized veneer sheets of the same length and stacking the thus severed veneer sheets in good trim, the sized veneer sheets need to be fed each by each at a certain interval. In order to automatically obtain such necessary interval of sized veneer sheet-feeding in a conventional method, it is inevitably necessary to prolong the time for cutting or feeding a veneer sheet to be severed, leading to decrease in productivity.

A further drawback of the conventional severing device is that not only the cutter member but also parts connected to it are driven by a power source so that sufficient severing force is available during the severing operation. As a result, there is required a driving means of high power to shuttle the cutter member.

It is therefore an object of the present invention to provide a method of severing a veneer sheet which enables the severing operation without stopping the feed of a veneer sheet for improving efficiency in the manufacture of plywood.

Another object of the present invention is to provide a method as described wherein severed veneer sheets are fed alternately into two different directions.

A further object of the present invention is to provide a method of the character described, wherein a high power drive means for the cutter member is not necessary.

A still further object of the present invention is to provide a device capable of effectively conducting the method as mentioned above.

A still further object of the present invention is to provide a device of the kind described, which is simple in construction and can be manufactured at a reasonable cost.

In one aspect of the present invention, there is provided a method of severing a veneer sheet comprising feeding a veneer sheet using a feeding means including a pair of members adapted to hold a veneer sheet therebetween, said feeding means being continuously driven, sensing an irregularity or a predetermined length of said veneer sheet and actuating a cutter member adapted to pivot in response to a signal from a means for transmitting a signal in accordance with the sensing of the irregularity or the predetermined length of the veneer sheet and to cut the veneer sheet in cooperation with a force by which said veneer sheet is fed, said cutter member being adapted to cut the veneer sheet in each of the pivotal movements of the cutter member which are made alternately in the clockwise and counterclockwise directions.

In another aspect of the present invention, there is provided a device for severing a veneer sheet comprising a veneer sheet feeding means continuously driven and including a pair of members adapted to hold a veneer sheet therebetween, a cutter member pivotally disposed on the feed-out side of the veneer sheet feeding means and having an edge portion adapted to work on the side of the fed-in veneer sheet, a means for sensing an irregularity or a predetermined length of said veneer sheet, a means for transmitting a signal in accordance with the sensing of the irregularity or the predetermined length of the veneer sheet and an actuator for actuating in response to said signal the cutter member to pivot and cut the veneer sheet in cooperation with a force by which the veneer sheet is fed, the severed veneer sheets being adapted to be fed out in two different directions respectively of the upside and downside of the cutter member.

These and other objects, features and advantages of the invention may be readily understood from the following detailed description and appended claims taken in connection with the accompanying drawings.

DETAILED DESCRIPTION

Figure 1:
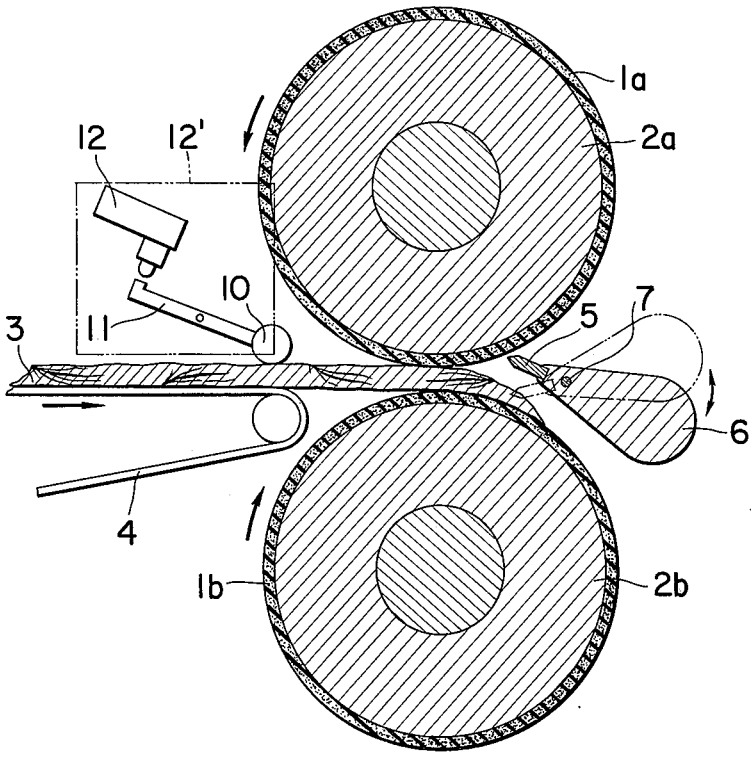
FIG. 1 is a sectional side view of a veneer sheet severing device embodying the present invention.

Referring now to FIG. 1 there is shown a device for severing a veneer sheet including steel or rubber rolls 2*a* and 2*b* with cylinders 1*a* and 1*b* of a resilient material respectively fitted therearound. Practically, omission of such cylinders does not cause a fatal defect, but the cylinders 1*a* and 1*b* are preferably provided for protecting an edge portion of the cutter member.

The rolls 2*a* and 2*b* are disposed leaving a space for holding and feeding a veneer sheet 3 therebetween and are driven in the arrow-marked direction by a motor (not shown).

The rolls 2*a* and 2*b* mentioned in the foregoing may be replaced by a pair of steel or rubber belts.

A conveyer belt 4 is provided on the feed-in side of the rolls so that the veneer sheet 3 is conveyed to near the rolls. A cutter member comprising an edge portion 5 and a body portion 6 is pivotally disposed on the feed-out side of the rolls 2*a* and 2*b*. The cutter member is adapted to pivot on a pin 7 in response to a signal from a signal transmitting means through an actuator (which will be mentioned later) to cut the veneer sheet 3 in each of the pivotal movements of the cutter member which are made alternately in the clockwise and couterclockwise directions.

Figure 5:
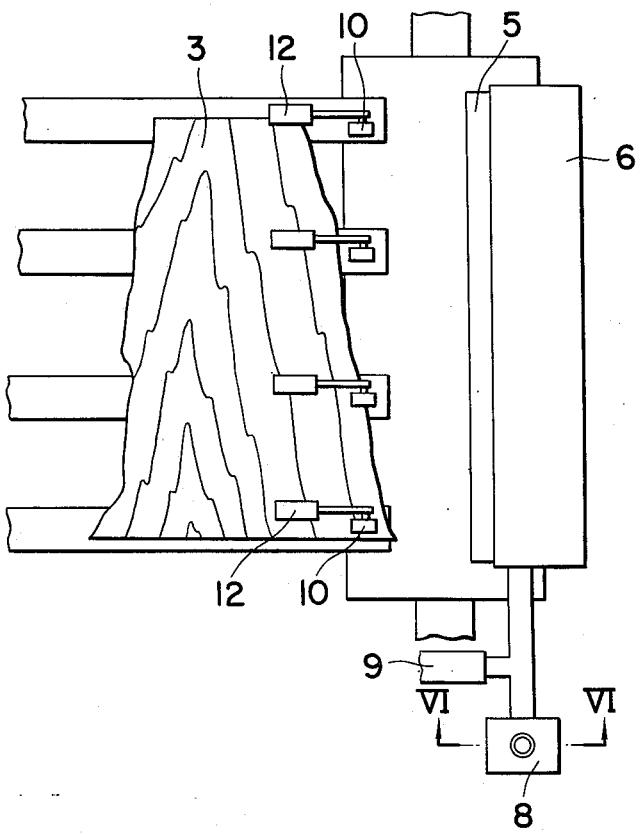
FIG. 5 is a plan view of the veneer sheet severing device in FIG. 1, with the upper member of feeding means taken away and with a rotary actuator added.

Referring to FIGS. 1 and 5, in the device of this invention is provided a sensing means 12′ for sensing a condition of the sheet, such as an irregularity in thickness of the veneer sheet 3. In accordance with an operation of said sensing means, the signal transmitting means transmits, with a time delay, a signal for actuating the cutter member. The sensing means 12′ comprises a plurality of units, each including a roller 10 and a limit switch comprising a movable contact 11 and a fixed contact 12. The roller 10 is rotatably supported on one end of the movable contact 11. The movable contact 11 is pivotally supported on a pin so that when the roller 10 is lifted, the other end of the movable contact 11 goes out of contact with the fixed contact 12 and when the roller 10 is lowered, the other end of the movable contact 11 comes into contact with the fixed contact 12.

Said plurality of units are so disposed that they are positioned over the whole breadth of the veneer sheet and the row of them is substantially at a right angle with a feed line of the fed veneer sheet as depicted in FIG. 5.

Numeral 8 designates a rotary actuator which is employed, in this embodiment, as an actuator for actuating the cutter member and which is fixedly connected to one end of the pivot pin 7 of the cutter member. The other end of the pivot pin 7 is rotatably supported by a suitable means (not shown). In respect of this actuator, the detailed explanation will be given later.

Figure 9:
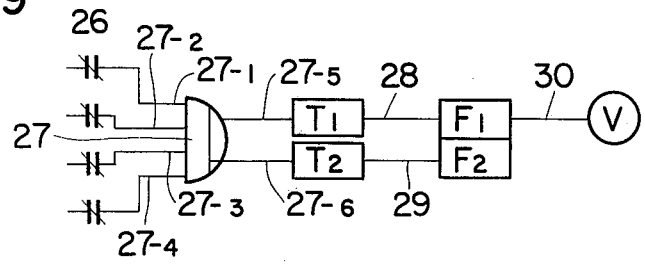
FIG. 9 is an electric circuit diagram showing the wiring between limit switches and the electromagnetic valve.
Figure 10:
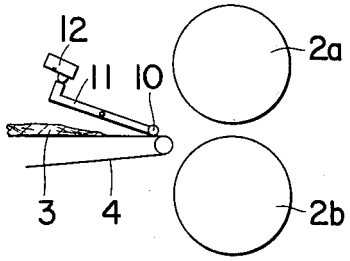
FIGS. 10 and 11 are diagrammatic views illustrating how a sensing means operates in association with the feeding of a veneer sheet.
Figure 11:
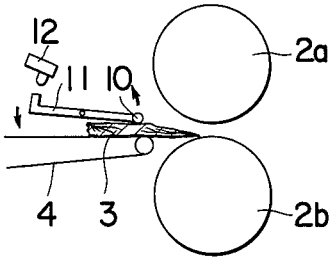

Referring to FIGS. 9, 10 and 11, the signal transmitting means comprising an "OR" circuit 27, timers $T_1$ and $T_2$ and a memory device comprising an "ON" signal receiving means $F_1$ and an "OFF" signal receiving means $F_2$, sends a signal, when actuated by closing or opening, due to an irregularity of the veneer sheet in thickness which is sensed by the sensing means, of the limit switches 26 electrically connected to the OR circuit 27, to an electromagnetic valve V. In response to the signal the electromagnetic valve V is energized or deenergized to actuate the cutter member shown in FIG. 1. Each of the limit switches 26 in FIG. 9 comprises the movable contact 11 and the fixed contact 12 shown in FIG. 1. When the veneer sheet 3 is not under the roller 10 yet as shown in FIG. 10 or when the veneer sheet 3 under the roller 10 is not so thick as a predetermined value, at least one of the limit switches 26 is closed, in other words, the movable contact 11 and the fixed contact 12 of the limit switch come into contact with each other, and, as a result, the signal transmitting means transmits a signal, with a time delay, for actuating the cutter member to pivot in the clockwise direction. Next, when the veneer sheet 3 having an acceptable thickness comes under the roll 10 as shown in FIG. 11, all of the limit switches 26 are opened, in other words, the movable contacts 11 and the fixed contacts 12 of the limit switches 26 go out of contact with each other and, as a result, the signal transmitting means transmits a signal, with a time delay for actuating the cutter member to pivot in the counterclockwise direction. The timers $T_1$ and $T_2$ are provided in the signal transmitting means for giving a time delay between the sensing of an irregularity and the actuation of the cutter member to adjust the timing of severing the veneer sheet 3 to an arrival thereof within the cutting zone since there is some distance between the positions of the sensing means 12′ and the cutter member. It is noted that the sensing means 12′ may comprise a plurality of units, each including a photoelectric tube for sensing an irregularity in breadth of the veneer sheet if uniform thickness is not necessarily required in sized veneer sheets as long as an exact rectangular shape is obtained.

Figure 6:
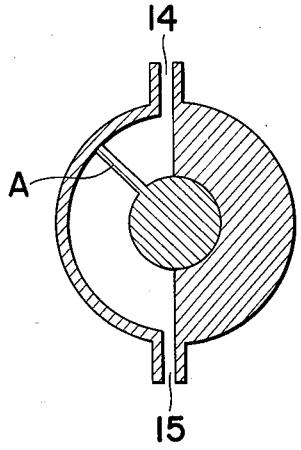
FIG. 6 is a cross sectional view of the rotary actuator taken along the line VI — VI of FIG. 5.

Referring to FIG. 6, there is illustrated the structure of the rotary actuator employed as an actuator in this embodiment. Numerals 14 and 15 designate ports through which air flows into the rotary actuator. Character A designates a vane which is fixedly connected to one end of the pin 7 of the cutter member and is pivotable by an inflow of air.

Figure 7:
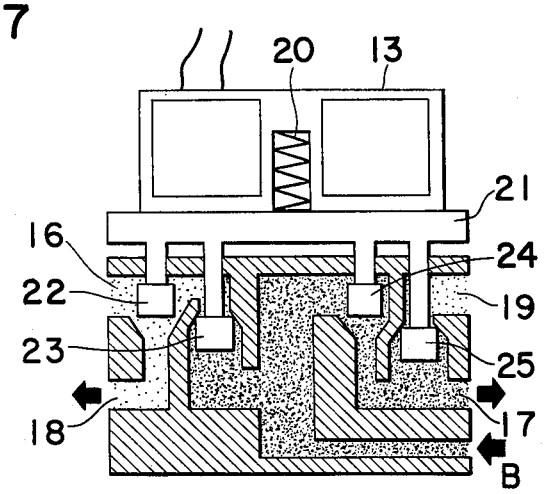
FIG. 7 is a sectional view of an electromagnetic valve for operating the rotary actuator, illustrating the position of a movable iron element when energized, with an electromagnet or solenoid shown in a diagrammatic view.
Figure 8:
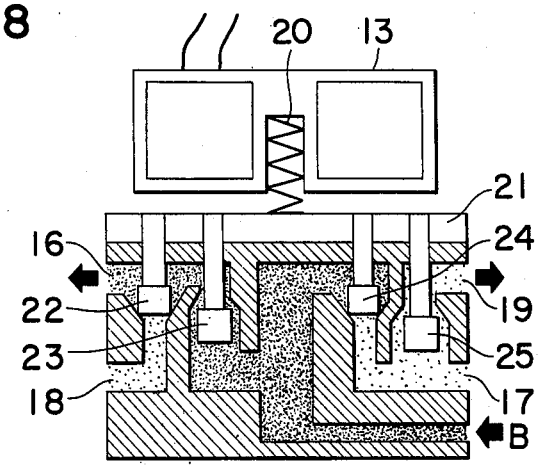
FIG. 8 is a sectional view similar to FIG. 7 illustrating the position of the movable iron element when deenergized.

Referring to FIGS. 7 and 8, there is illustrated the electromagnetic valve V which is employed for operating the rotary actuator 8. The electromagnetic valve comprises an electromagnet or solenoid 13, a valve body, and a movable element 21 made of a magnetic material. In the valve body, there are outlets 16 and 17, exhausts 18 and 19. The movable element 21 having valves 22, 23, 24 and 25 are disposed as depicted. The electromagnet 13 is adapted to be energized by receiving the signal from the signal transmitting means. The movable element moves up and down by the action of the electromagnetic force exerted by the electromagnet 13 and the action of a compression spring 20, respectively. According to the movement of the movable element 21, the valves 22, 23, 24 and 25 effectively function to make the compressed air flow into the rotary actuator through the ports 14 and 15 alternately. As a result, the rotary actuator 8 can be actuated in response to the signal from the signal transmitting means.

In operation, if the veneer sheet 3 is not yet under the rollers 10, all of the limit switches 26 each comprising the movable contact 11 and the fixed contact 12 are kept on as illustrated in FIG. 10. When all the limit switches 26 are closed, the OR circuit 27 in the signal transmitting means emits an ON signal at a feed-out side 27-5 to the timer $T_1$ where transferring of the ON signal to the memory device is delayed. The thus delayed signal goes into the ON signal receiving means $F_1$ of the memory device which is provided to render the signal transmitting means continue to transmit the signal unless the OFF signal receiving means $F_2$ of the memory device receives an OFF signal which will be explained later and then the signal is transmitted from the signal transmitting means. The thus transmitted signal is received by the electromagnetic valve V. (See, FIG. 9)

The moment the electromagnetic valve V receives the signal from the signal transmitting means, the electromagnetic valve V is energized as shown in FIG. 7, wherein the electromagnet 13 is magnetized and attracts the movable iron element 21. At this instant, the valves 22 and 24 are opened while the valves 23 and 25 are closed.

This electromagnetic valve is continuously supplied at a constant rate with the compressed air B from outside into the arrow-marked direction as shown in FIGS. 7 and 8. The compressed air B fed from outside is flown to the outlet 17 which communicates to the port 15 of the rotary actuator shown in FIG. 6.

By the inflow of the compressed air B into the actuator through the port 15 thereof, the vane A fixed to the pin 7 of the cutter member is pivoted in the clockwise direction and, at the same time, the cutter member is pivoted correspondingly. The pivotal movement of the cutter member is stopped by a stop 9 shown in FIG. 5 and accordingly, the vane A is stopped at a position as shown in FIG. 6. The position of the cutter member at this very moment is exactly as shown by full lines in FIG. 1.

The emission of the ON signal at the feed-out side 27-5 lasts as long as at least one of the limit switches 26 is kept on due to poor thickness of the veneer sheet from side to side even if the veneer sheet is already under the rollers 10 since the OR circuit 27 will not emit a signal at the feed-out side 27-6 unless all the switches are turned off.

Then, when the veneer sheet having an acceptable thickness from side to side comes under the rollers 10, all the rollers 10 are lifted, turning off all the limit switches 26 whereby an OFF signal is emitted at the feed-out side 27-6 of the OR circuit 27.

However, it is not until the thus emitted OFF signal reaches the OFF signal receiving means $F_2$ of the memory device with a time delay worked out in the timer $T_2$ for the purpose of adjusting the timing of energization of the electromagnetic valve V to the arrival of the veneer sheet having an acceptable thickness from side to side within the cutting zone that the ON signal kept transmitted ceases to be transmitted and the electromagnetic valve V gets deenergized.

Figure 2:
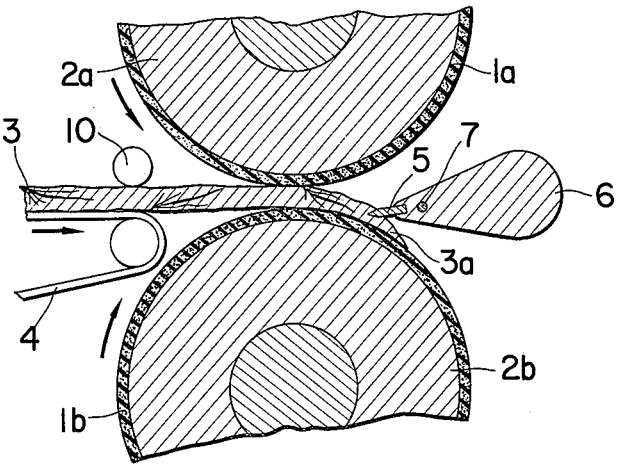
FIG. 2 is a view similar to FIG. 1, illustrating the state in which the cutter member starts to cut veneer sheet.
Figure 3:
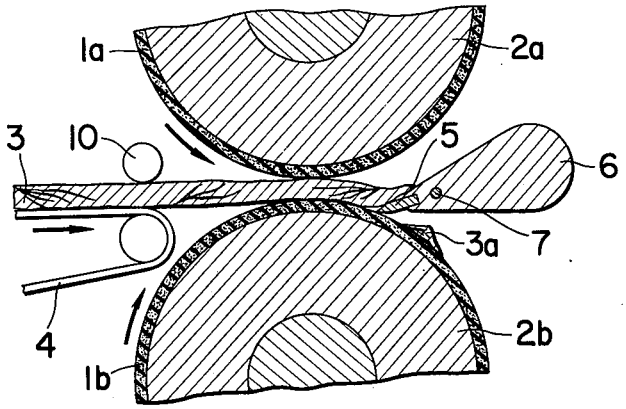
FIG. 3 is a view similar to FIG. 1 and FIG. 2, illustrating the state in which the cutter member completes cutting off of an inferior portion of the veneer sheet.
Figure 4:
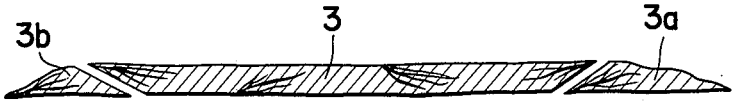
FIG. 4 is a sectional side view of the veneer sheet with the inferior portions cut off according to a method of this invention.

When the electromagnetic valve gets deenergized the movable element 21 is pushed away from the electromagnet by a compression spring 20. As a result, the valves 22 and 24 are closed while the valves 23 and 25 are opened and then, the compressed air B fed from outside is flown to the outlet 16 which communicates to the port 14 of the rotary actuator 8. By the inflow of the compressed air B into the actuator through the port 14 thereof, the vane A connected to the pin 7 of the cutter member is pivoted in the counterclockwise direction. This pivotal movement is transmitted to the cutter member, which pivots in the counterclockwise direction and the cutter member starts to sever the veneer sheet as shown in FIG. 2 for removing a inferior quality portion **3*a* off of the veneer sheet 3 as shown in FIG. 3, in cooperation with the force by which the veneer sheet 3** is fed. Illustratively stated, while the veneer sheet proceeds toward the edge portion of the cutter member, said edge portion pivots from the upper side to the lower side of the veneer sheet, thereby to effectively accomplish cutting.

In this way, the severing operation proceeds until the cutter member contacts the periphery of the roll **2*b* and the pivotal movement of the cutter member is stopped by the stop 9 provided for the purpose of maintaining the edge portion 5 on the side of the fed-in veneer sheet as well as preventing the edge portion 5 from being broken on contact with the roll 2*b*. The moment the edge portion 5 contacts the periphery of the roll 2*b*, the severing of the veneer sheet 3 is completed and the inferior quality portion 3*a* cut off the veneer sheet 3 is automatically separated from the veneer sheet of acceptable quality, goes through a passage formed between the cutter member and the lower roll 2*b* and is discarded as a scrap. On the other hand, the veneer sheet from which the inferior quality portion 3*a* is removed goes through the passage formed between the cutter member and the upper roll 2*a*** and is fed along the upper side of the cutter member without being stopped.

Further, the moment another inferior quality portion **3*b* comes into the reach of the cutter member, the cutter member positioned as shown by a broken line in FIG. 1 starts to pivot in a clockwise direction in response to a signal transmitted from the signal transmitting means in such a way as described and the cutter member starts to sever the veneer sheet in cooperation with the force by which the veneer sheet is fed and the severing operation proceeds until the cutter member contacts the periphery of the roll 2*a* and the pivotal movement of the cutter member is stopped by the stop 9**.

In this way, the severing operation is performed.

Another embodiment of the present invention is useful in severing a single veneer sheet which does not contain the inferior quality portions into two groups of veneer sheets, each sheet having the same length.

Figure 12:
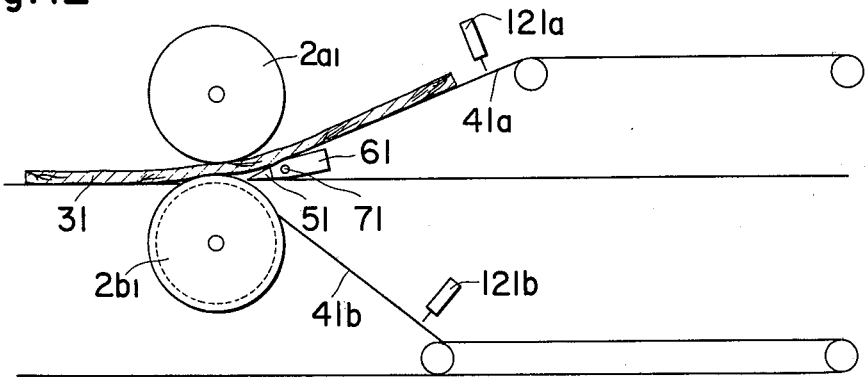
FIG. 12 is a diagrammatic view showing another embodiment of the present invention.

Referring to FIG. 12 there is shown a device for severing a veneer sheet including steel or rubber rolls $2a_1$ and $2b_1$ which are disposed leaving a space for holding and feeding a veneer sheet 31 therebetween and driven by a motor (not shown) so that the roll $2a_1$ rotates in the counterclockwise direction while the roll $2b_1$ in the clockwise direction. A cutter member comprising an edge portion 51 and a body portion 61 is pivotally disposed on the feed-out side of the rolls $2a_1$ and $2b_1$. The cutter member is adapted to pivot on a pin 71 in response to a signal from a signal transmitting means (not shown) through an actuator (not shown) to sever the fed veneer sheet 31 in each of the pivotal movements of the cutter member which are made alternately in the clockwise and counterclockwise directions. Said signal transmitting means transmits a signal in accordance with an operation of a means for sensing a predetermined length of the veneer sheet. Sensing means, for example limit switches 121*a* and 121*b* are disposed as such respectively on two different passages on the feed-out side of the rolls $2a_1$ and $2b_1$ with a predetermined distance from the cutter member. The sensing means 121*a* and 121*b* energize the signal transmitting means which transmits a signal in such a way that when the sensing means 121*a* senses a forward end of the fed veneer sheet 31, the cutter member pivots in the counterclockwise direction.

Figure 13:
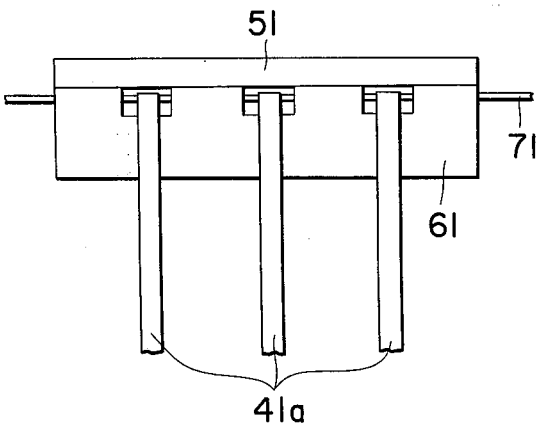
FIG. 13 is an enlaged plan view showing the state of combination of the cutter member and a severed veneer sheet conveyer means employed in FIG. 12.

Conveyor belts 41*a* for feeding the veneer sheet 31 out into one of two different directions pass over the pin 71 and are arranged with a spacing between each other as shown in FIG. 13.

Conveyor belts 41*b* for feeding the veneer sheet 31 out into the other of the two different directions pass over the grooves formed, with a spacing therebetween, around the periphery of the roll $2b_1$ as shown by a dotted line in FIG. 12.

In operation, when a cutter member comprising the edge portion 51 and the body portion 61 is positioned in such a way that the cutter member points to the lower roll $2b_1$, the single veneer sheet 31 goes through a passage formed between the upper roll $2a_1$ and the cutter member and proceeds along the upper surface of the cutter member and the conveyor belt 41*a*.

The moment the forward end of the fed veneer sheet 31 reaches the sensing means 121*a*, the sensing means or limit switch 121*a* is operated to energize the signal transmitting means to transmit a signal. In response to the signal the actuator actuates the cutter member to pivot in the clockwise direction and the cutter member severs the veneer sheet 31 to obtain a veneer sheet having a predetermined length. After the severing, the continuously fed veneer sheet 31 changes its course along the lower surface of the cutter member and is carried on the conveyor belts 41*b* while the sized veneer sheet having a predetermined length is fed into one of two different directions along the conveyor belts 41*a*.

The moment the new forward end of the veneer sheet 31 which is carried on the conveyor belt 41*b* reaches the sensing means 121*b*, the sensing means 121*b* is operated to energize the signal transmitting means to transmit a signal. In response to the signal the actuator actuates the cutter member to pivot in the counterclockwise direction and the cutter member severs the veneer sheet to obtain another sized veneer sheet having a predetermined length. After the severing, the continuously fed veneer sheet 31 changes again its course along the upper surface of the cutter member and is carried on the conveyor belts 41*a* while the sized veneer sheet having a predetermined length is fed into the other one of the two different directions along the conveyor belts 41*b*.

The sized veneer sheets, after the above mentioned severings are done, are fed alternately to two different places for stacking or for drying if required.

It is also possible to use the instant embodiment in order to prepare veneer sheets having a predetermined length from those having different lengths. For example, a plurality of veneer sheets having inferior portions already removed but having various lengths are fed successively into the instant device and subjected to severing operation to obtain a train of veneer sheets which train has a predetermined length. When such train of veneer sheets are sliced, there can be easily obtained two groups of veneer sheets having predetermined lengths.

According to modification of the first embodiment, there can be obtained a veneer sheet having a predetermined length from a plurality of veneer sheets having different lengths and fed at different intervals therebetween. In practising, however, there is needed, in place of an ordinary sensing means, a specific type sensing means, for example, comprising in combination a photoelectric tube and an integrating meter. Such specific type sensing means is disposed on the feed-in side of the veneer sheet feeding means. A plurality of veneer sheets having various lengths are fed at various intervals. As the veneer sheets are fed, the sensing means senses the veneer sheets and integrates the lengths of the veneer sheets having passed. When the integrated lengths of veneer sheets come to a predetermined value, the sensing means operates the signal transmitting means to transmit a signal, with a time delay for adjusting timing of actuation of the cutter member as mentioned before. In response to the signal, the actuator actuates the cutter member. As a result, there are obtained groups of veneer sheets with the terminal veneer sheets cut. Each group of veneer sheets are spliced to obtain a veneer sheet having a predetermined length. As to the sensing means, a combination of a roller and a switch may, instead of a photoelectric tube, be used.

As described, according to this invention, the difficulties and shortcomings described in the description of the prior art are obviated. More specifically, the severing operation can be performed without stopping feeding of veneer sheet and the feeding force is effectively used for severing the veneer sheets. As a result, the increased productivity is obtained. Even if a preceding operation such as a continuous preparation of veneer sheets from a log and the severing operation are planned to be performed in combination, the veneer sheet is not subject to unfavorable back pressure due to continuous feeding of the veneer sheet prepared from a log since the severing operation is performed also continuously.

Furthermore, when the method and the device according to the present invention are used for removing inferior quality portions from a veneer sheet, cut-off scraps and veneer sheets of acceptable quality can be separated on the spot. In other words, they are fed into two different directions after the severing is done. On the other hand, when a veneer sheet which does not contain inferior quality portions is to be severed into two groups of sized veneer sheets of the same length, severed veneer sheets are fed alternately along two different passages, at certain intervals between veneer sheets fed into each direction. Such feeding-out at an interval makes it possible to perform the severing operation and a subsequent operation in combination. For instance, if the severed veneer sheets are to be stacked at a yard etc., they are required to be fed there each by each with sufficient intervals in order to smoothly carry out the stacking operation. In any conventional method and device, it is impossible to obtain such sufficient intervals without decreasing productivity. By contrast, intervals as large as the length of a severed veneer sheet are obtained by the method and the device according to the present invention as easily understood from the description and FIG. 12.

Furthermore, in the present invention, since the veneer sheet feeding force is effectively utilized for severing, it is not necessary for the cutter member to be driven by a large force, leading to considerable reduction of mass of the cutter member as well as saving of power for the cutter member. As a result, the severing machine can be made compact as compared with the conventional one.

Thus, the work severing veneer sheets is speeded up, labor of separating inferior quality portions from veneer sheets of acceptable quality is obviated. Moreover, the severing operation can be performed systematically with other operations involved in the manufacture of plywood such as cutting of a veneer sheet off of a log, stacking of severed veneer sheets, etc.

As described, with the method and the device of the present invention, the manufacture of plywood can be done with ease and high productivity.

What is claimed is:

1. A method of severing a veneer sheet, comprising the steps of feeding a veneer sheet using a feeding means including a pair of members adapted to hold a veneer sheet therebetween, said feeding means being continuously driven to cause continuous feeding movement of said sheet between said members toward a cutter element, sensing a dimensional condition of said veneer sheet, and swingably displacing said cutter element transversely across the sheet in accordance with the sensing of said condition of the veneer sheet for cutting the veneer sheet due to the continuous feeding movement of the sheet toward the cutting element during the swinging thereof, said cutter element effecting cutting of the veneer sheet in each of the pivotal movements of the cutter element which are made alternatelty in the clockwise and counterclockwise directions.

2. A method according to claim 1, wherein said dimensional condition is the thickness of the veneer sheet.

3. A method according to claim 1, wherein said dimensional condition is the breadth of the veneer sheet.

4. A method according to claim 1, wherein said dimensional condition is the length of the veneer sheet.

5. A method of severing a veneer sheet, comprising the steps of:

continuously moving a veneer sheet in a selected direction along a path;

providing a cutter element mounted for swinging movement about an axis substantially parallel with the veneer sheet and substantially perpendicular to said selected direction, and positioning said cutter element with the cutting edge thereof projecting upstream toward the leading edge of the moving sheet;

sensing a preselected condition of said veneer sheet as it moves along said path;

actuating the cutter element in response to sensing of the preselected condition for swingably displacing the cutting edge of said cutter element from a first position located on one side of the moving sheet into a second position located on the other side of the moving sheet; and severing the moving sheet as the cutting edge moves transversely thereacross between said first and second positions.

6. A method according to claim 5, wherein the preselected condition comprises one of the dimensions of the sheet.

7. A method according to claim 5, including the steps of swingably displacing said cutting edge from said second position into said first position in response to a further sensing of said preselected condition and further severing said sheet as said cutting edge swingably moves transversely thereacross from said second position into said first position.

8. A method according to claim 7, wherein the preselected condition comprises one of the dimensions of the sheet.

9. A method according to claim 8, wherein the dimension is the thickness of the sheet.

10. A method according to claim 8, wherein the dimension is the breadth of the sheet.

11. A method according to claim 8, wherein the dimension is the length of the sheet.

12. A method according to claim 7, wherein said veneer sheet is continuously moved between a pair of opposed support rollers which are positioned for engagement with the opposite sides of the veneer sheet, and wherein said cutting element is positioned closely adjacent the nip between said rollers adjacent the outfeed end of the nip for coaction with the moving leading edge of the sheet.

13. A method according the claim 12, wherein the cutting edge of said cutter element is disposed closely adjacent the periphery of one of the support rollers when in said first position and is disposed closely adjacent the periphery of the other support roller when in said second position.

14. A method according to claim 7, including the steps of deflecting the severed part of the sheet along a first discharge path responsive to swinging movement of the cutter element from said first position into said second position, and deflecting the severed part of the sheet along a second discharge path which is different from said first discharge path responsive to swinging movement of the cutter element from said second position into said first position.

* * * * *